US005957670A

United States Patent [19]

Duncan et al.

[11] Patent Number: 5,957,670

[45] Date of Patent: Sep. 28, 1999

[54] AIR DRIVEN DIAPHRAGM PUMP

[75] Inventors: Gregory S. Duncan, Huntington Beach; Eric L. Forman, Rancho Cucamonga, both of Calif.

[73] Assignee: Wilden Pump & Engineering Co., Colton, Calif.

[21] Appl. No.: 08/920,081

[22] Filed: Aug. 26, 1997

[51] Int. Cl.[6] ..... F04B 43/06

[52] U.S. Cl. ..... 417/395; 417/393

[58] Field of Search ..... 417/395, 393, 417/46; 137/338, 339, 102

[56] References Cited

U.S. PATENT DOCUMENTS

| | | | |
|---|---|---|---|
| D. 275,858 | 10/1984 | Wilden | D15/7 |
| D. 294,946 | 3/1988 | Wilden | D15/7 |
| D. 294,947 | 3/1988 | Wilden | D15/7 |
| 4,247,264 | 1/1981 | Wilden | 417/393 |
| 4,406,596 | 9/1983 | Budde | 417/393 |
| 4,549,467 | 10/1985 | Wilden et al. | 91/307 |
| 4,586,535 | 5/1986 | Stoll | 137/596.17 |
| 4,674,958 | 6/1987 | Igarashi et al. | 417/225 |
| 4,854,832 | 8/1989 | Gardner et al. | 417/393 |
| 5,169,296 | 12/1992 | Wilden | 417/395 |
| 5,213,485 | 5/1993 | Wilden | 417/393 |
| 5,326,234 | 7/1994 | Versaw et al. | 417/393 |
| 5,362,212 | 11/1994 | Bowen et al. | 417/395 |
| 5,366,353 | 11/1994 | Hand | 417/375 |
| 5,368,452 | 11/1994 | Johnson et al. | 417/395 |
| 5,378,122 | 1/1995 | Duncan | 417/395 |
| 5,584,666 | 12/1996 | Kozumplik, Jr. et al. | 417/46 |
| 5,607,290 | 3/1997 | Duncan | 417/393 |

*Primary Examiner*—Charles G. Freay
*Assistant Examiner*—Paul L. Ratcliffe
*Attorney, Agent, or Firm*—Lyon & Lyon LLP

[57] ABSTRACT

A pump having a center section including an actuator housing and an air valve is arranged with air chambers to either side of the actuator housing. Diaphragms are associated with the air chambers to create enclosed cavities for alternately pressurizing and venting the air chambers. Pumping chambers are positioned outwardly of the diaphragms and assembled with intake and exhaust manifolds and one-way valves to pump materials with operation of the diaphragms. The actuator uses a pilot shifting shaft which is shuttled by movement of the diaphragms. An air valve is controlled by the pilot shifting shaft to control flow to and from the air chambers. Diffusers include outwardly tapered oblong holes with ports from the air valves. An expansion chamber surrounds the diffusers and a exit to a standard muffler provides a smaller cross-sectional area than the diffuser outlet cross-sectional area.

8 Claims, 13 Drawing Sheets

AIR DRIVEN DIAPHRAGM PUMP

BACKGROUND OF THE INVENTION

The field of the present invention is pumps and actuators for pumps having air driven diaphragms.

Pumps having double diaphragms driven by compressed air directed through an actuator valve are well known. Reference is made to U.S. Pat. Nos. 5,213,485; 5,169,296; and 4,247,264; and to U.S. Pat. Nos. Des. 294,946; 294,947; and 275,858. An actuator valve using a feedback control system is disclosed in U.S. Pat. No. 4,549,467. The disclosures of the foregoing patents are incorporated herein by reference.

Common to the aforementioned patents on air driven diaphragm pumps is the presence of an actuator housing having air chambers facing outwardly to cooperate with pump diaphragms. Outwardly of the pump diaphragms are pump chamber housings with inlet manifolds and outlet manifolds. Ball check valves are also positioned in both the inlet passageways and the outlet passageways. The actuator between the air chambers includes a shaft running therethrough which is coupled with the diaphragms. An air valve controls flow to alternate pressure and exhaust to and from each of the air chambers so as to result in reciprocation of the pump. The air valve is controlled by a pilot system controlled in turn by the position of the pump diaphragms. Thus, a feedback control mechanism is provided to convert a constant air pressure into a reciprocating distribution of pressurized air to each air chamber. A vast range of materials are able to be pumped safely and efficiently using such systems.

Air driven systems, using the expansion of compressed gasses to convert potential energy into work, can experience problems of icing when there is moisture in the compressed gas. As the gas expands, it cools and is unable to retain as much moisture. The moisture condensing from the cooled gas can collect in the passageways and ultimately form ice. This can result in less efficient operation and stalling. One solution is to be found in U.S. Pat. No. 5,607,290, the disclosure of which is incorporated herein by reference.

SUMMARY OF THE INVENTION

The present invention is directed to an air driven diaphragm pump and to actuators therefor to minimize icing. An air driven diaphragm pump having passageways from the air chambers venting to atmosphere through a valve includes a diffuser outlet from the valve for self purging. The diffuser allows for a distribution of expanding gases from a constrained area with a diverging surface making ice formation difficult. This configuration can assist in providing reduced icing within the actuator.

Accordingly, it is a principal object of the present invention to provide an improved actuator system for reciprocal air driven devices including pumps. Other and further objects and advantages will appear hereinafter.

DETAILED DESCRIPTION OF THE PREFERRED EMBODIMENT

Figure 1:
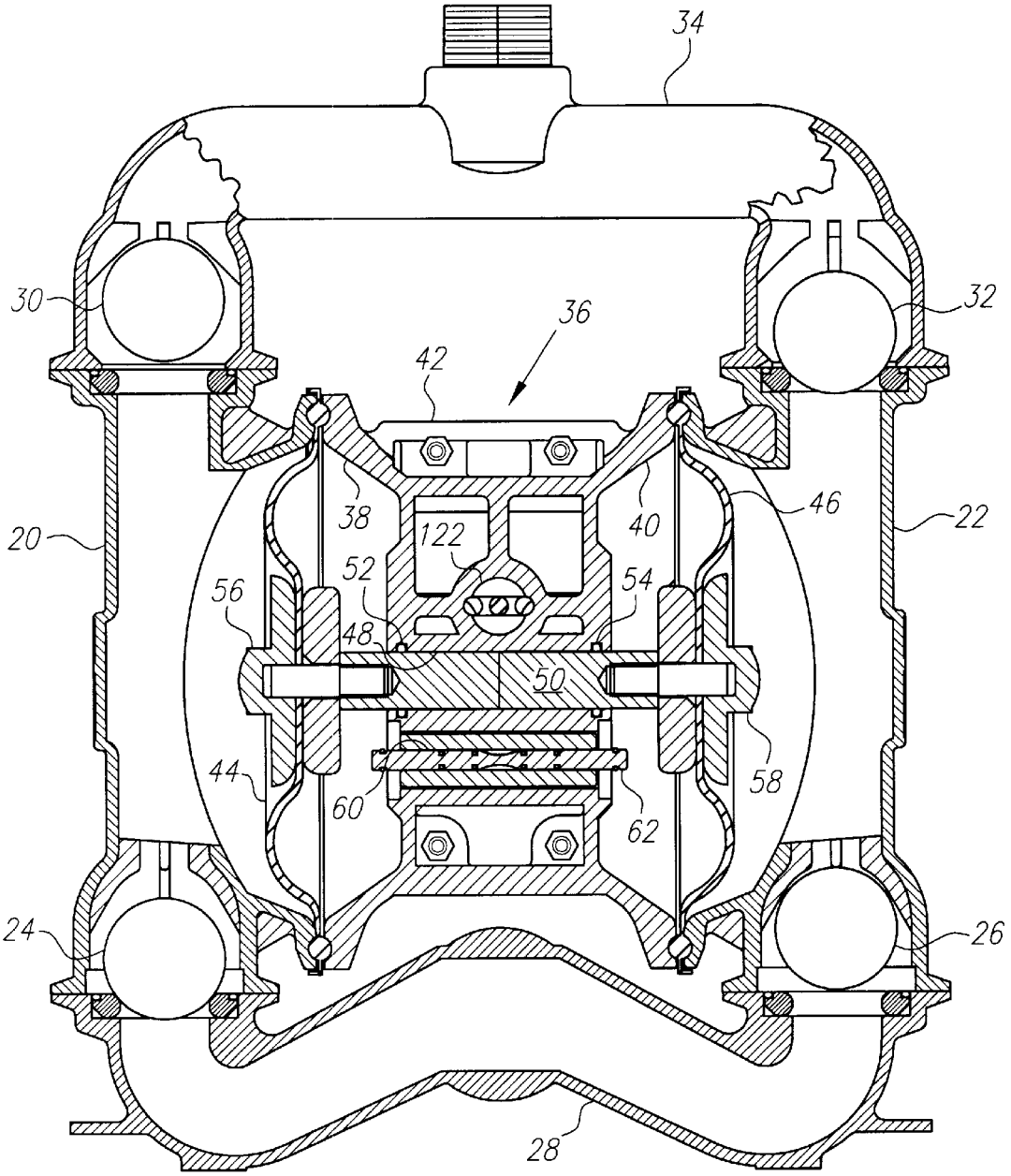
FIG. 1 is a cross section of an air driven diaphragm pump.
Figure 2:
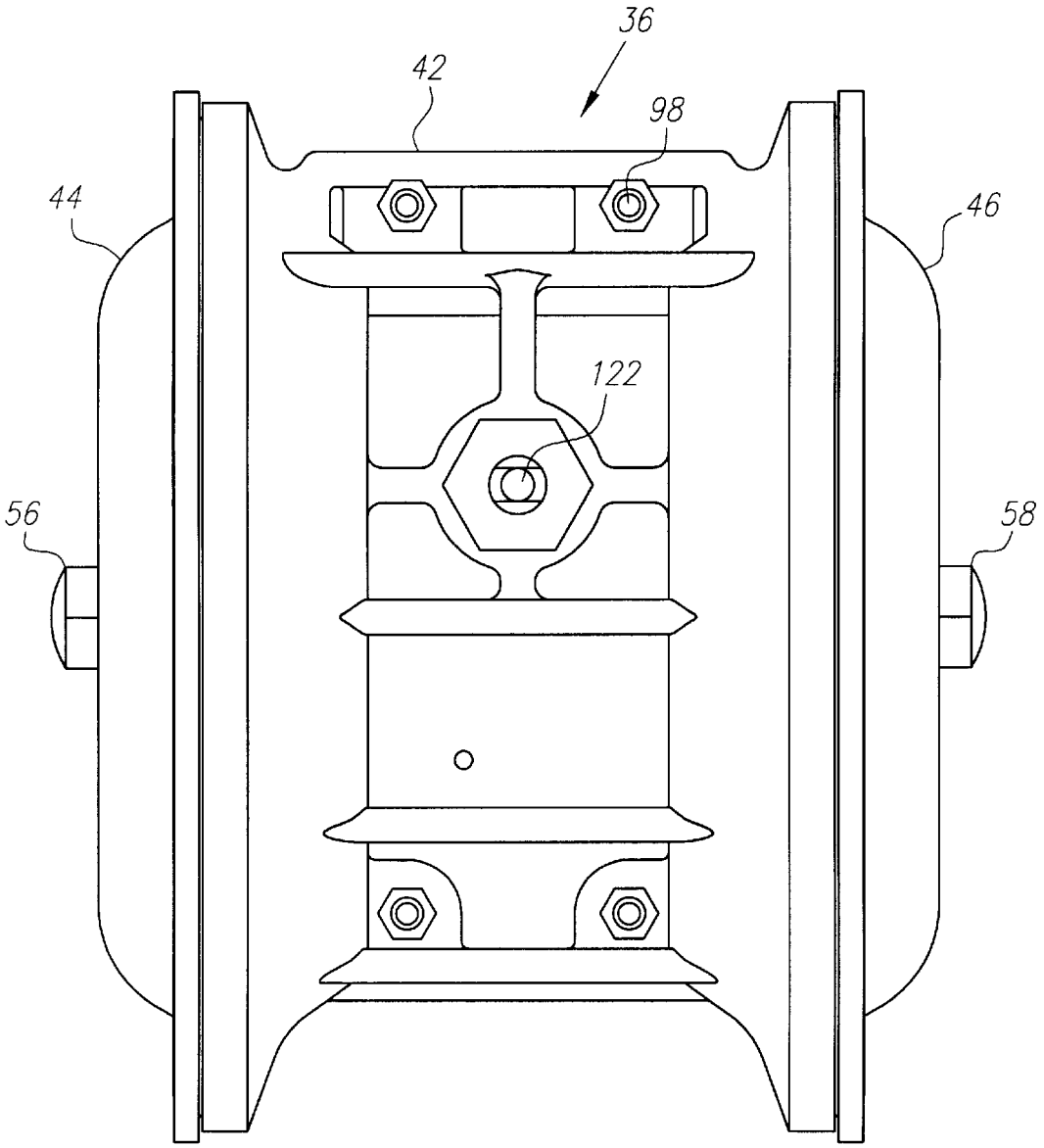
FIG. 2 is a front view of an actuator housing with diaphragms in place.
Figure 3:
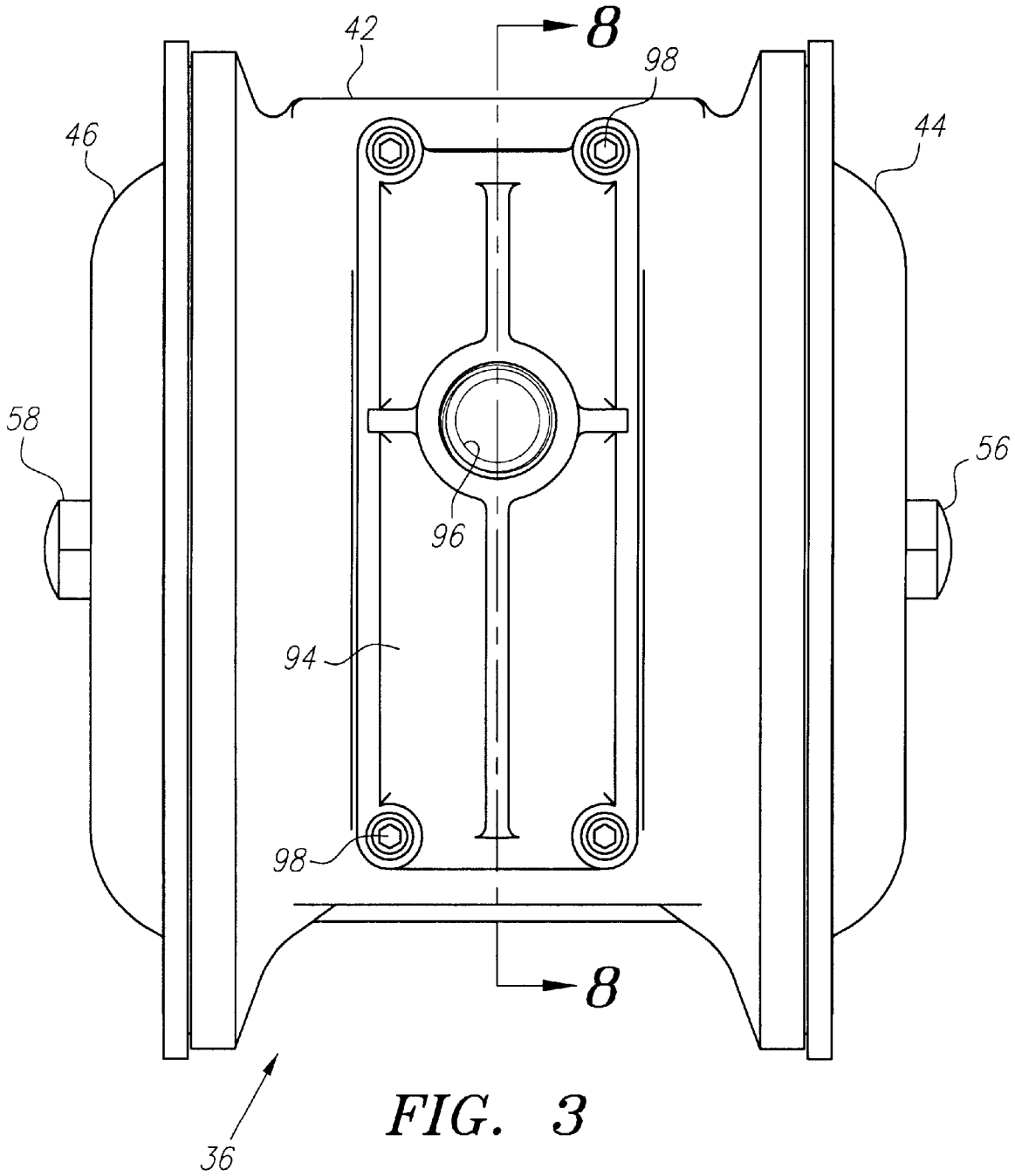
FIG. 3 is a back view of the assembly of FIG. 2.
Figure 4:
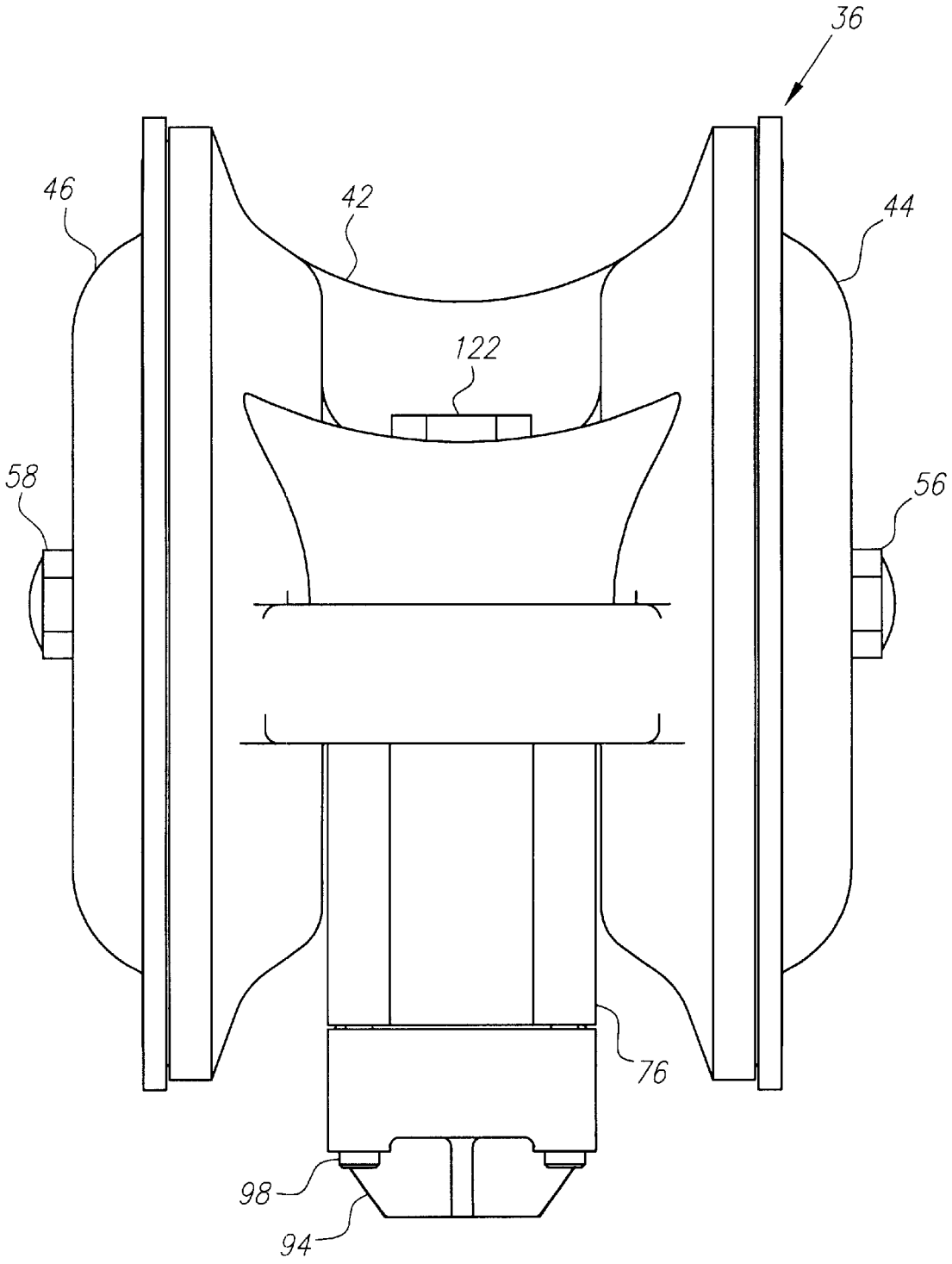
FIG. 4 is a top view of the assembly of FIG. 2.
Figure 5:
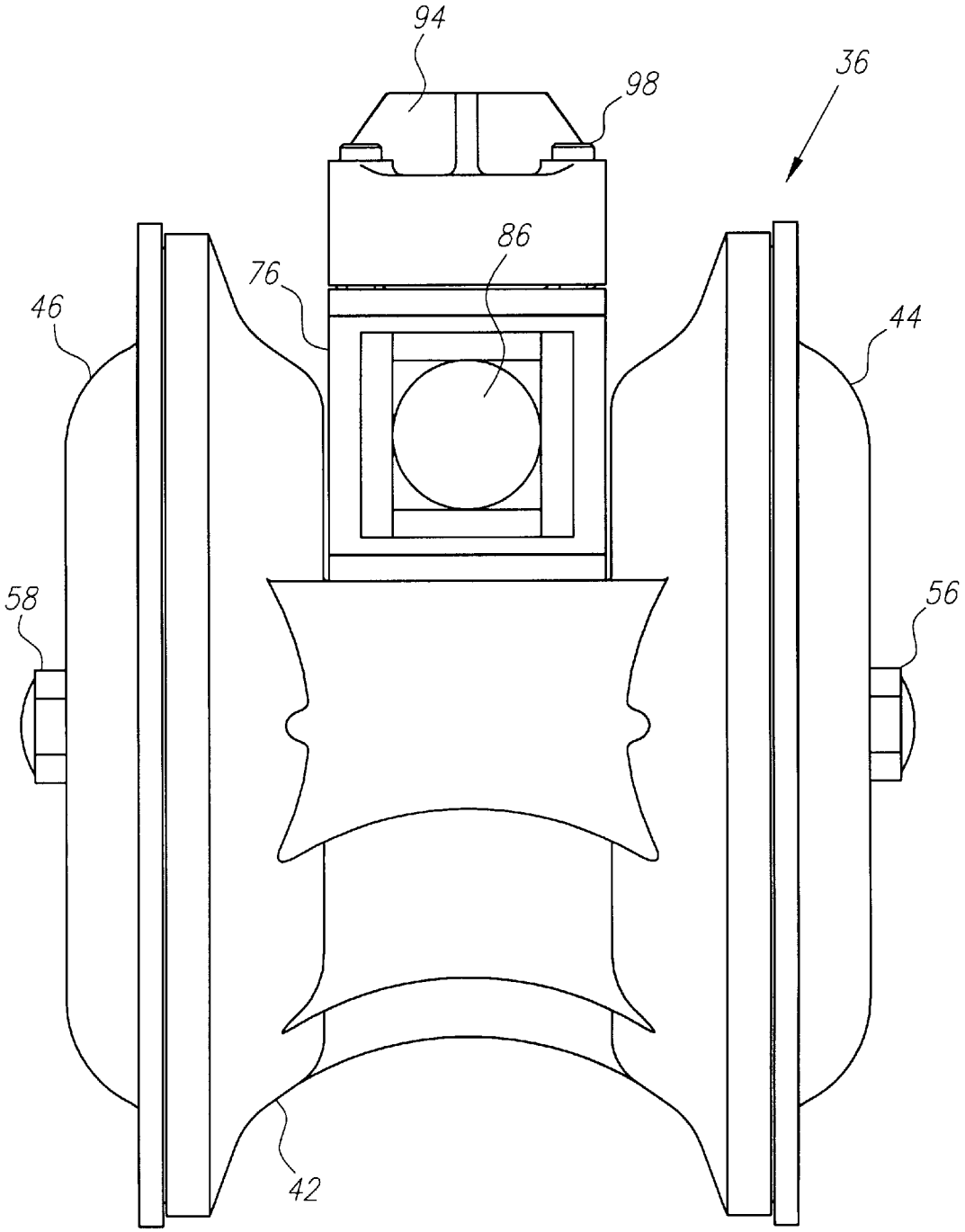
FIG. 5 is a bottom view of the assembly of FIG. 2.
Figure 6:
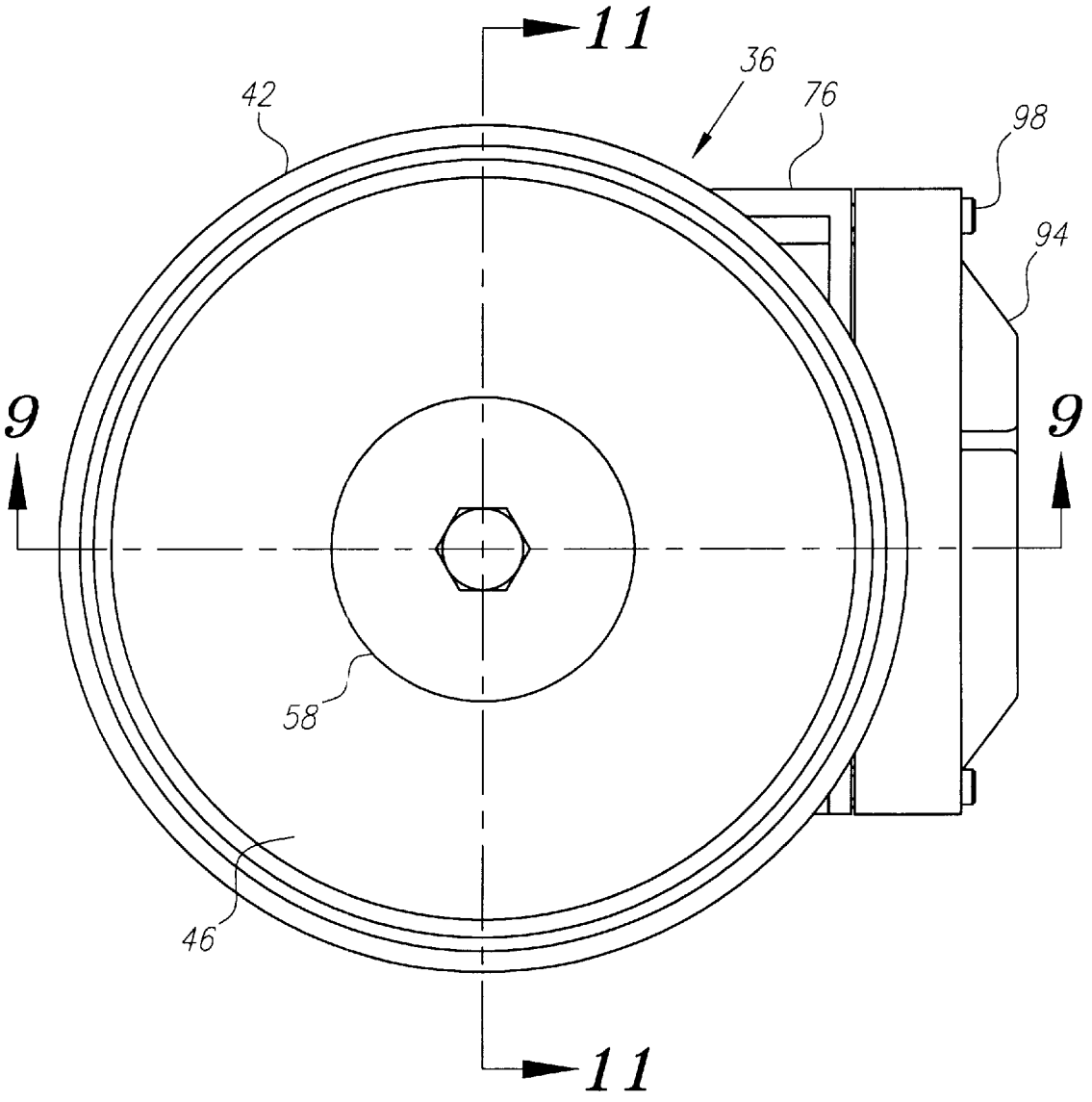
FIG. 6 is a side view of the assembly of FIG. 2.

Turning in detail to the drawings, FIG. 1 illustrates an air driven double diaphragm pump, illustrated in cross section for clarity. The pump structure includes two pump chamber housings 20 and 22. These pump chamber housings 20 and 22 each include a concave inner side forming pumping cavities through which the pumped material passes. One-way ball valves 24 and 26 are at the lower end of the pump chamber housings 20 and 22, respectively. An inlet manifold 28 distributes material to be pumped to both of the one-way ball valves 24 and 26. One-way ball valves 30 and 32 are positioned above the pump chamber housings 20 and 22, respectively, and configured to provide one-way flow in the same direction as the valves 24 and 26. An outlet manifold 34 is associated with the one-way ball valves 30 and 32.

Inwardly of the pump chamber housings 20 and 22, a center section, generally designated 36, includes air chambers 38 and 40 to either side of an actuator housing 42. There are two pump diaphragms 44 and 46 arranged in a conventional manner between the pump chamber housings 20 and 22 and the air chambers 38 and 40, respectively. The pump diaphragms are retained about their periphery between the corresponding peripheries of the pump chamber housings 20 and 22 and the air chambers 38 and 40.

Figure 9:
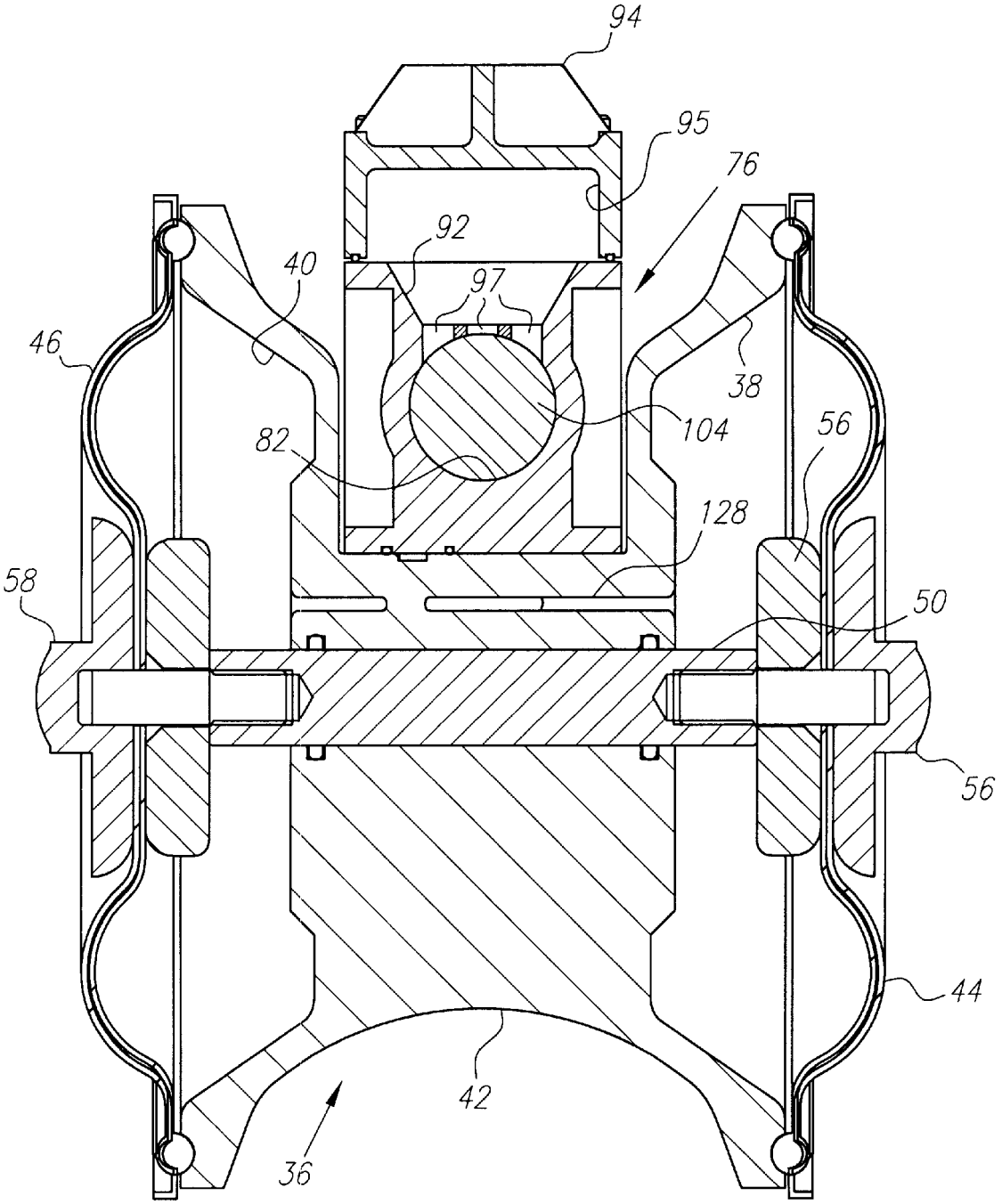
FIG. 9 is a cross-sectional view taken along line 9—9 of FIG. 6.

The actuator housing 42 provides a first guideway 48 which is concentric with the coincident axes of the air chambers 38 and 40 and extends to each air chamber. A shaft 50 is positioned within the first guideway 48. The guideway 48 provides channels for seals 52 and 54 as a mechanism for sealing the air chambers 38 and 40, one from another, along the guideway 48. The shaft 50 includes piston assemblies 56 and 58 on each end thereof. These assemblies 56 and 58 include elements which capture the centers of each of the pump diaphragms 44 and 46 as best illustrated in FIG. 9. The shaft 50 causes the pump diaphragms 44 and 46 to operate together to reciprocate within the pump.

Figure 11:
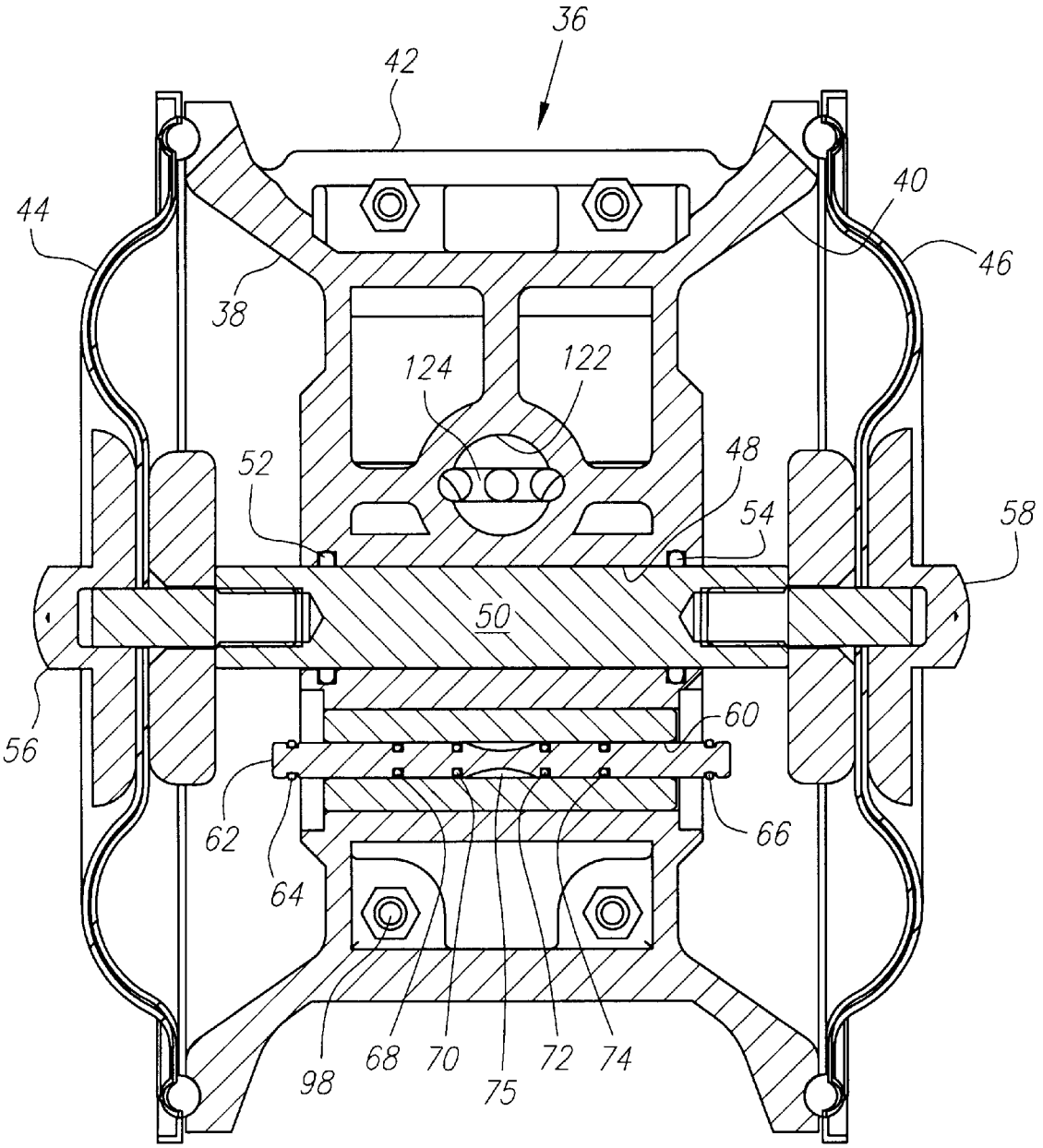
FIG. 11 is a cross-sectional view taken along line 11—11 of FIG. 6.
Figure 12:
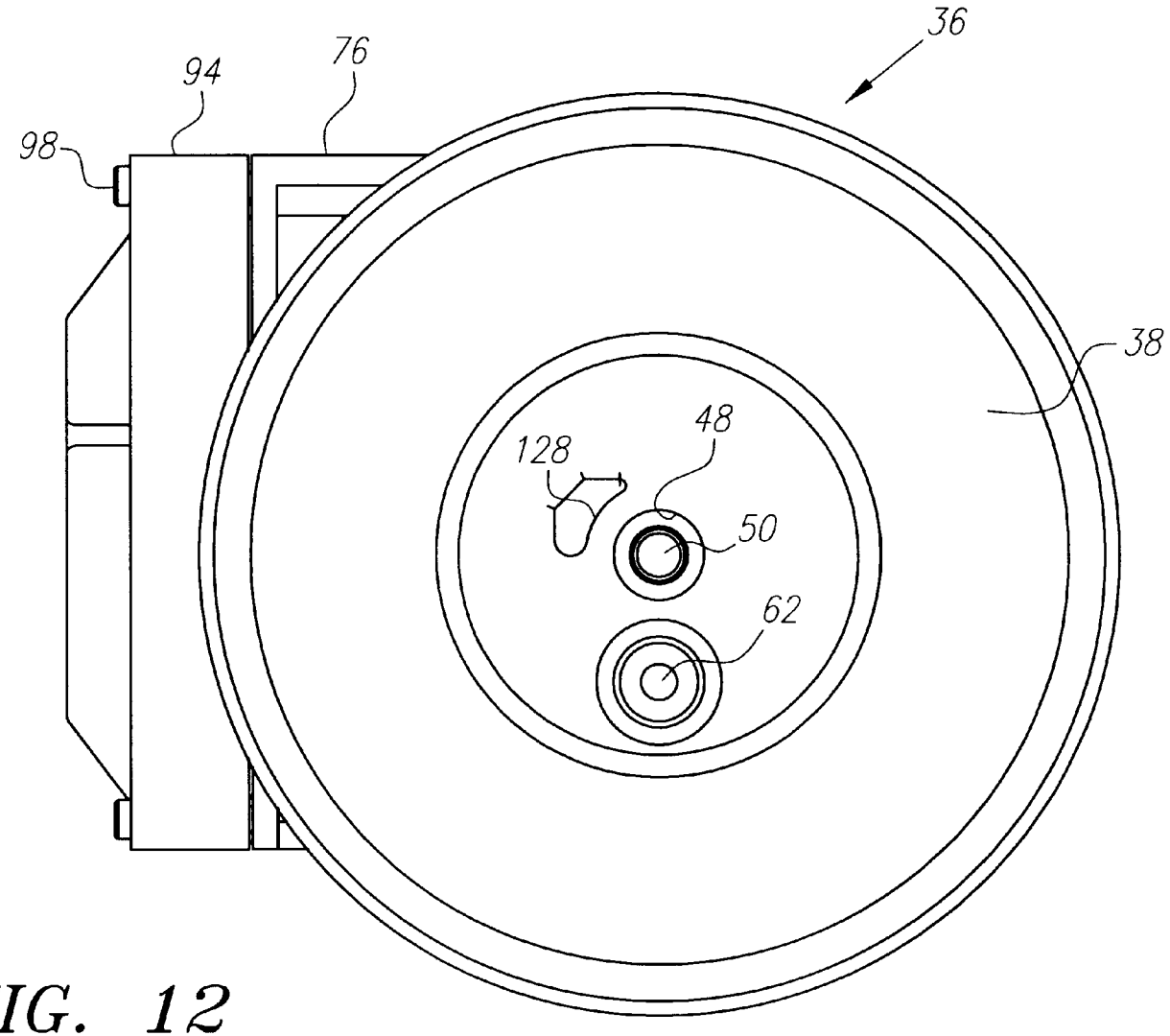
FIG. 12 is a side view of the actuator housing with the diaphragm and diaphragm piston removed for clarity.

Also located within the actuator housing 42 is a second guideway 60 within which a pilot shifting shaft 62 is positioned. The guideway, defined by a bushing, extends fully through the center section to the air chambers 38 and 40 with countersunk cavities at either end. The pilot shifting shaft 62 extending through the second guideway 60 also extends beyond the actuator housing 42 to interact with the inside surface of the piston assemblies 56 and 58. As can be seen in FIG. 11, the pilot shifting shaft 62 can extend into the path of travel of the inner faces of either one of the assemblies 56 and 58. Thus, as the shaft 50 reciprocates, the pilot shifting shaft 62 is driven back and forth. The pilot shifting shaft 62 includes channels for two O-rings 64 and 66 and for four seals 68, 70, 72 and 74. The O-rings 64 and 66 prevent overtravel of the pilot shifting shaft 62. The seals 68 and 74 provide sealing between the guideway 60 and the air chambers 38 and 40. The inner seals 70 and 72 seal an axial passage 75 of reduced diameter in the shaft 62.

Associated with the actuator housing 42 is an air valve, generally designated 76. Locator holes 77 in the actuator housing 42, shown in FIG. 7, cooperate with pins (not shown) in the air valve 76 to locate the air valve 76. The air valve 76 includes a valve cylinder 78. The valve cylinder 78 includes a cylindrical bore 80 extending partially therethrough such that the bore 80 is closed at one end by the body of the valve cylinder 78. The cylindrical bore 80 may be divided into two sections 82 and 84. Section 82 is of a smaller diameter than section 84. The cylindrical bore 80 is closed at the end of the large section 84 by an end cap 86. The end cap 86 extends into the large section 84 of the cylindrical bore 80. An O-ring 90 is arranged about the end cap 86 to seal with the cylindrical bore 80.

Diffusers 92 and 93 are defined in the air valve 76. These diffusers 92 and 93 are positioned adjacent the valve cylinder 78, extending from an inlet at the section 82 of the cylindrical bore 80 to an outlet to provide exits from the air valve 76. An external exhaust housing 94 defines an expansion chamber 95 surrounding the diffusers 92 and 93. A threaded bore 96 through the housing 94 accommodates a standard muffler (not shown). The expansion chamber outlet, especially with a standard muffler mounted therein provides a smaller outlet than the cross-sectional outlet area of either of the diffusers which vent air chambers alternately. The expansion chamber 95 additionally acts as a receiver of any ice developed in the diffusers 92 and 93.

Figure 8:
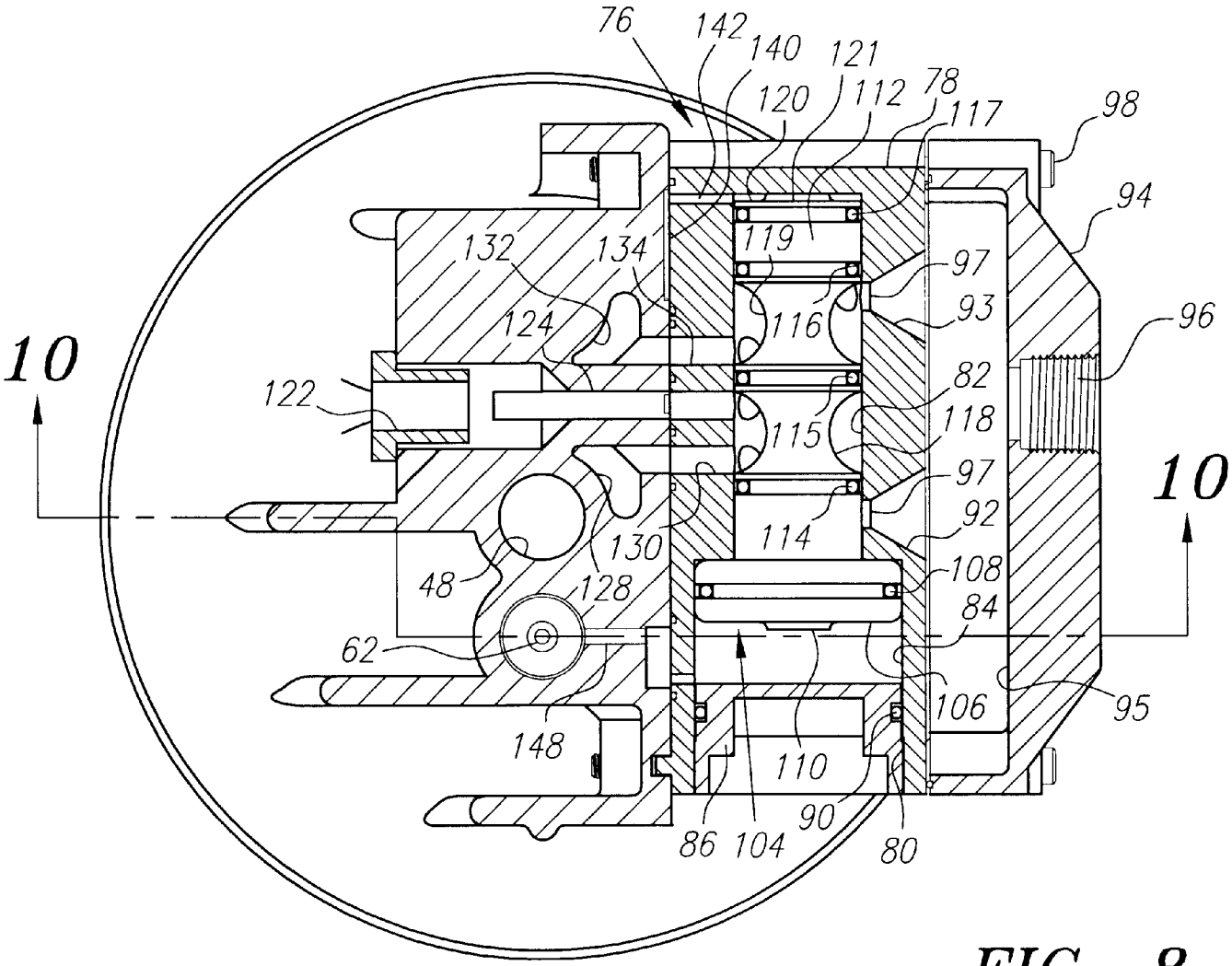
FIG. 8 is a cross-sectional view taken along line 8—8 of FIG. 3.
Figure 13:
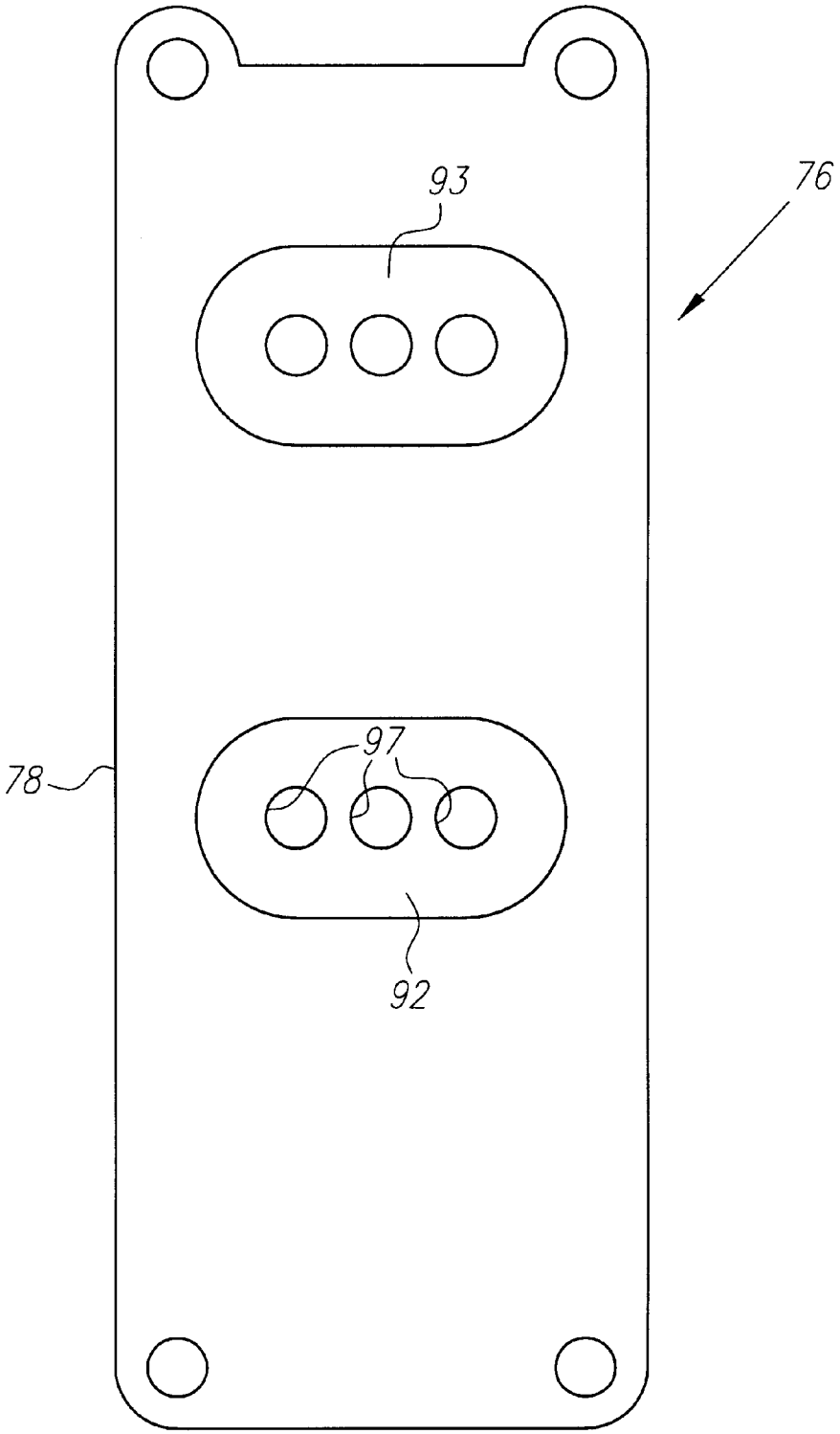
FIG. 13 is a view of the diffuser side of the air valve with the exhaust housing removed.

The diffusers 92 and 93, shown in FIGS. 8, 9 and 13, are elongate in cross section and divergent. They are rounded such that the cross section of each is oblong. The oblong diffusers 92 and 93 extend transversely relative to the axis of the cylindrical bore 80. This orientation presents the inlet as elongate in line with the seals of a valve piston within the cylindrical bore 80. Thus, more area is opened with less valve travel than would occur with a circular hole of the same total area. The angle of the sides of the diffusers from the axial has been conveniently selected to be between 40° and 45°. The empirical results of this over conventional ports show an advantage. Further testing may show some variation on this angle to be advantageous depending upon the pumping pressure and other conditions.

Three ports 97 extend between the cylinder bore section 82 and each of the diffusers 92 and 93. These ports 97 are as short as practical. The walls between the ports 97 provide cylinder surface upon which the piston seals are supported on a valve piston as it slides in the cylinder portion 82. This wall effect is presented approximately parallel to the axis of the cylindrical bore to span the distance across the port. Any support configuration so spanning this distance would be appropriate. If the seals need not be considered, a fully open oblong port at the inlet of the diffusers 92 and 93 would be appropriate.

The air valve 76 is retained on the actuator housing 42 by four fasteners 98. The fasteners 98 retain the housing 94 in position as well as compress the air valve 76 against the actuator housing 42.

The air valve 76 includes a valve piston, generally designated 104, which is positioned within the valve cylinder 78 in the cylindrical bore 80. The valve piston 104 includes a large piston end 106 having a seal 108 in a receiving channel. The large piston end 106 fits closely within the large section 84 of the cylindrical bore 80. A small raised portion 110 insures an annular space between the end of the valve piston 104 and the end cap 86 with the valve piston 104 positioned toward the large end 106.

The valve piston 104 also includes a piston body 112 which is smaller in diameter than the large piston end 106. The piston body 112 includes four seals 114, 115, 116 and 117. Between the seals 114 and 115 the piston body 112 is reduced in diameter to provide an axial passage 118 for the flow of air. The piston body 112 includes another axial passage 119 where the diameter is also reduced between the seals 115 and 116. A small piston 120 is defined at the end of the piston body 112. The seal 117 seals the bore around the piston 120. A small raised portion 121 on the small piston 120 insures an annular space at that end with the valve piston 104 positioned toward the small end of the cylindrical bore 80.

Figure 7:
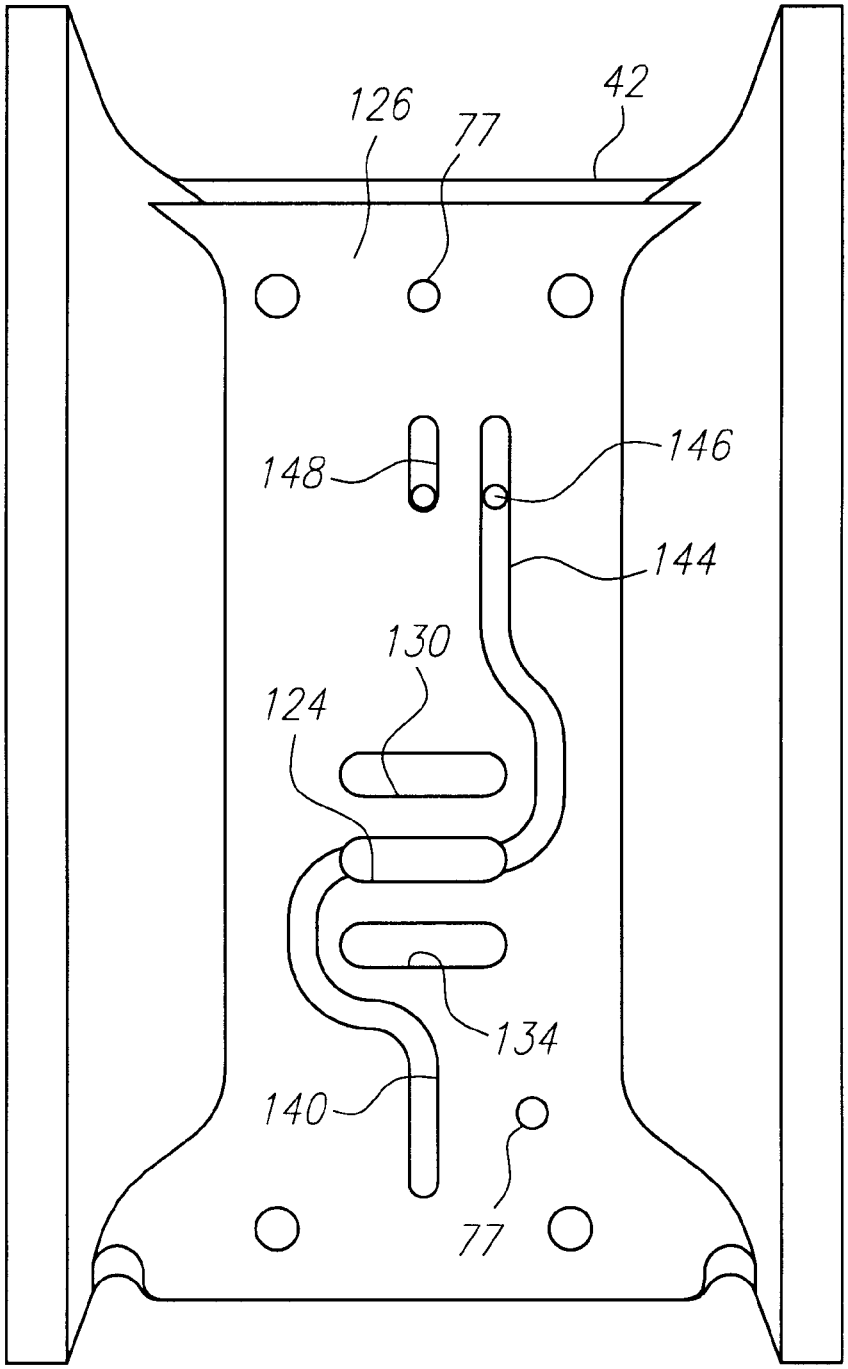
FIG. 7 is a back view of the actuator housing with the air valve removed for clarity.

To appropriately describe the passageways within the actuator housing 42 and the air valve 76, reference will also be made to the operation of the system. An inlet 122 is provided on one side of the actuator housing 42 and extends by an inlet passage 124 through to the face 126 of the actuator housing 42, as seen in FIG. 7, which mates with the air valve 76. The inlet passage 124 extends across the face 126 and through the valve cylinder 78 to the cylindrical bore 80.

The location of the valve piston 104 at the extreme positions within the cylindrical bore 80 dictates the communication of the inlet passage 124 with the air chambers 38 and 40. As seen in FIG. 8, the inlet 122 is in communication with the axial passage 118 of the piston body 112 between the seals 114 and 115. The axial passage 118 is also in communication with an air chamber passage 128. Thus, the inlet pressure is communicated with the air chamber passage 128. The air chamber passage 128 extends inwardly through the valve cylinder 78 and then laterally to the air chamber 38. As can be seen from FIG. 7, there is a port 130 extending downwardly to the passage 128. Were the valve piston 104 positioned at the other extreme within the valve cylinder 78, the inlet passage 124 would communicate with the axial passage 119 of the piston body 112 between the seals 115 and 116. In this way, the inlet passage 124 would be in communication with the air chamber passage 132 through a port 134. The air chamber passage 132 communicates with the air chamber 40.

The diffusers 92 and 93 extend outwardly through the valve cylinder 78 from the cylindrical bores 80. As can be seen in FIG. 8, when the valve piston 104 is positioned toward the small end, the air chamber passage 132 is in communication with the diffuser 93. With the valve piston 104 positioned toward the large end, the air chamber passage 128 is in communication with the diffuser 92. Thus, with the valve piston 104 positioned toward the small end, pressurized air is provided to the air chamber 38; and the air chamber 40 is opened to exhaust. The reverse is true with the valve piston 104 at the other end. By reciprocating the valve piston 104, the pump is driven to reciprocate as well.

To reciprocate the valve piston 104, the differential areas of the two ends of the valve piston 104 are employed. With reference to FIG. 7, the inlet passage 124 communicates with a passageway 140 which, as seen in FIG. 8, communicates with a passage 142 extending through the valve cylinder 78 to the small end of the valve piston 104. This communication between the small piston 120 and the inlet 122 is always open.

Figure 10:
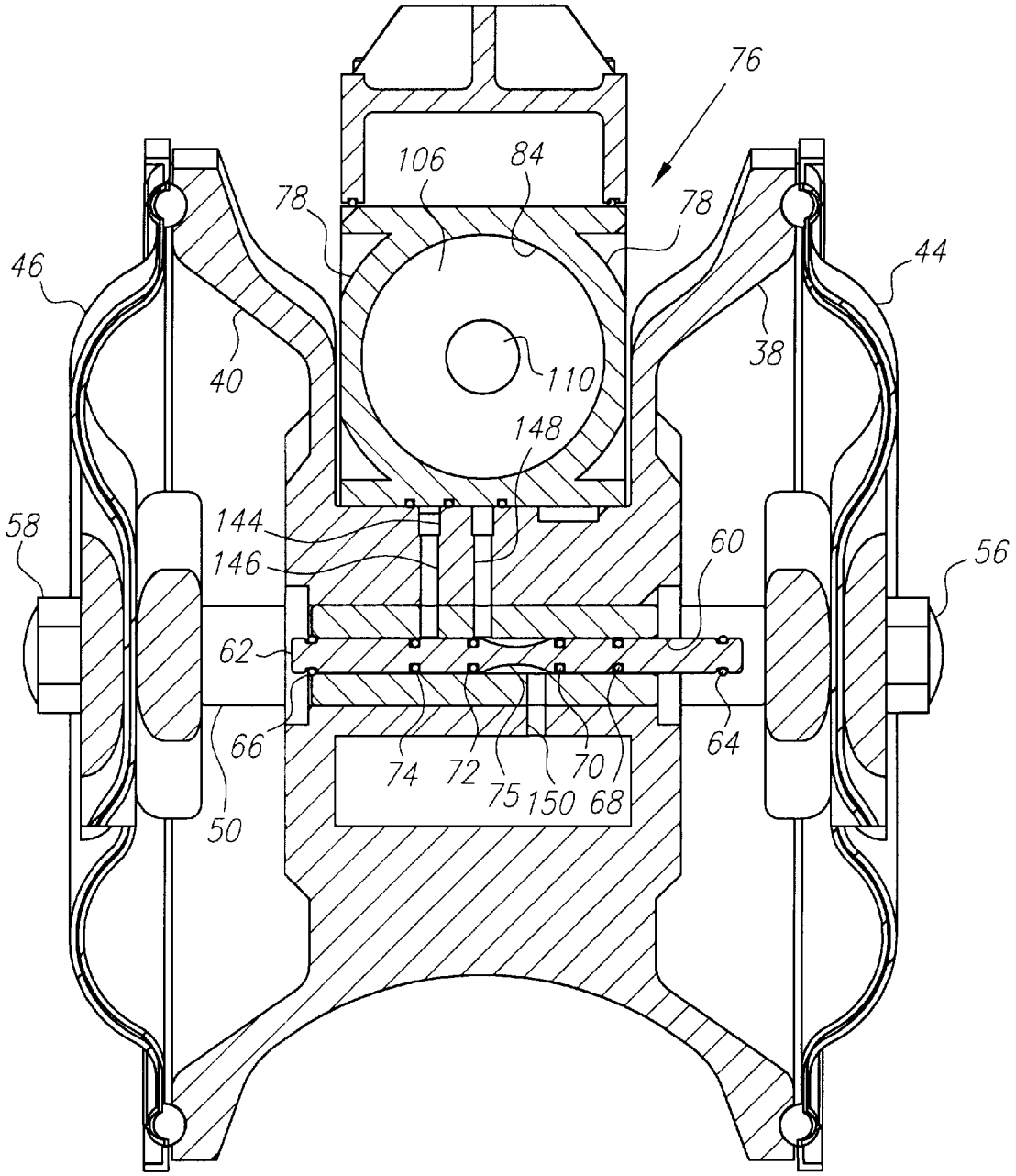
FIG. 10 is a cross-sectional view taken along line 10—10 of FIG. 8.

Also associated with the inlet passage 124 is a passageway 144 as best seen in FIG. 7. This passageway 144 extends to a passage 146 extending through the actuator housing 42 to the second guideway 60 as best seen in FIG. 10. The passage 146 is controlled by the seal 72. As the pilot shifting shaft 62 moves from one extreme position to the other, the seal 72 crosses the passage 146 to provide communication to the axial passage 75 between the seals 70 and 72. This axial passageway communicates the passage 146 with a further passage 148 extending to the large end of the cylindrical bore 80. Thus, communication between the inlet 122 and the large end of the cylindrical bore 80 is controlled by the pilot shifting shaft 62. With the pilot shifting shaft 62 in the position as illustrated in FIG. 10, an exhaust passage 150 is in communication with the passage 148 to vent the large end 84 of the cylindrical bore 80.

With the small end of the valve piston 104 always pressurized and the large piston end 106 controlled by the pilot shifting shaft 62, the location of the valve piston 104 may be controlled. When both ends of the valve piston 104 are pressurized, more force is exerted on the larger end. Consequently, the valve piston 104 moves to the small end in the position as illustrated in FIG. 8. When the pressure on the large piston end 106 is released by movement of the pilot shifting shaft 62, the pressure on the small end then dominates and forces the valve piston 104 toward the large end.

The pilot shifting shaft 62 determines the direction of pumping. Assuming that the pilot shifting shaft 62 is in a position where the large piston end 106 is vented (as seen in FIG. 10), the valve piston 104 will be forced toward the large end by the continuous pressure exerted on the small end thereof. The position shown in FIG. 8 is before that shift. Once shifted, the air chamber 40 is in communication with the inlet passage 124 and the air chamber 38 is in communication with the diffuser 92. Thus, the pump will operate to move the diaphragms 44 and 46 until the piston assembly 58 of the diaphragm 46 contacts the end of the pilot shifting shaft 62. As the seal 72 crosses over the passage 146 at the completion of the diaphragm stroke, the large end 84 of the cylindrical bore 80 is pressurized. Pressurization of the large end of the cylindrical bore 80 causes the valve piston 104 to shift such that flow is reversed to the air chambers 38 and 40. This condition, shown in FIG. 8, then exists until the pilot shifting shaft 62 is shifted by the inner surface of the piston assembly 56. The process then repeats itself.

The configurations of the various passageways are designed to avoid the formation of ice. To accomplish this, expansion of compressed gas is controlled. To this end, the diffusers 92 and 93 are arranged to be the most susceptible to ice formation from air flow in the series of passages communicating exhausting flow from either of the air chambers 38 and 40. Consequently, ice formation occurs at the exit rather than in the body of the actuator housing 42 or the air valve 76.

The diffusers also contribute to a flow profile and to physical conditions which are conducive to ice free operation. As the subsonic air flow escapes from the cylinder 80, pressure is builds as velocity is reduced. As a result, an adiabatic increase in temperature occurs which reduces the tendency to develop ice. Further, the angle on the diffusers physically reduces the ability of ice to accumulate on the diffuser walls. The flow acts in shear to scrub ice away and may possibly also tend to pull the ice from the inclined wall of the diffuser. The physically larger area also makes the passageways less sensitive to any buildup of ice. Finally, the diffusers are used alternately with a diffuser devoted to each air chamber, respectively, which reduces the ice load on each one.

Thus, an improved actuation system for and in combination with an air driven diaphragm pump has been disclosed. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. An air driven diaphragm pump comprising an actuator having a housing including opposed air chambers and air chamber passages, an air valve with a cylindrical bore and a valve piston therein, the air chamber passages extending from each air chamber, respectively, to the air valve, and a diffuser having an inlet at the cylindrical bore and an outlet displaced therefrom, the diffuser being tapered outwardly from the inlet toward the outlet, the diffuser taper being oblong in cross section with the major axis extending transversely relative to the axis of the cylindrical bore of the air valve;

pump diaphragms extending across each air chamber, respectively, forming enclosed cavities.

2. The air driven diaphragm pump of claim 1, the diffuser including ports of minimal length between the cylindrical bore and the diffuser taper, the ports providing wall therebetween substantially parallel to the axis of the cylindrical bore of the air valve.

3. An air driven diaphragm pump comprising an actuator having a housing including opposed air chambers and air chamber passages, an air valve with a cylindrical bore and a valve piston therein, the air chamber passages extending from each air chamber, respectively, to the air valve, and a diffuser having an inlet at the cylindrical bore and an outlet displaced therefrom, the diffuser being tapered outwardly from the inlet toward the outlet;

pump diaphragms extending across each air chamber, respectively, forming enclosed cavities;

an exhaust housing including an expansion chamber about the diffuser, the exhaust housing including an outlet from the expansion chamber.

4. The air driven diaphragm pump of claim 3, the outlet of the exhaust housing being smaller in cross section than the total cross-sectional area of the diffuser at the outlet.

5. An actuator for an air driven reciprocating device having two air chambers with diaphragms extending across each air chamber, respectively, the actuator comprising an air valve including a cylindrical bore, a valve piston in the cylindrical bore and a diffuser having an inlet at the cylindrical bore and an outlet displaced therefrom, the diffuser being tapered outwardly from the inlet toward the outlet, the diffuser taper being oblong in cross section with the major axis extending transversely relative to the axis of the cylindrical bore of the air valve;

air chamber passages extending from each air chamber, respectively, to the air valve.

6. The actuator for an air driven reciprocating device of claim 5, the diffuser including ports of minimal length between the cylindrical bore and the diffuser taper, the ports providing all therebetween substantially parallel to the axis of the cylindrical bore of the air valve.

7. An actuator for an air driven reciprocating device having two air chambers with diaphragms extending across each air chamber, respectively, the actuator comprising an air valve including a cylindrical bore, a valve piston in the cylindrical bore and a diffuser having an inlet at the cylindrical bore and an outlet displaced therefrom, the diffuser being tapered outwardly from the inlet toward the outlet;

air chamber passages extending from each air chamber, respectively, to the air valve;

an exhaust housing including an expansion chamber about the diffuser, the exhaust housing including an outlet from the expansion chamber.

8. The actuator for an air driven reciprocating device of claim 7, the outlet of the exhaust housing being smaller in cross section than the total cross-sectional area of the diffuser at the outlet.

* * * * *